United States Patent [19]

Mitchell

[11] Patent Number: 4,771,916

[45] Date of Patent: Sep. 20, 1988

[54] PIVOTAL SPOUT WITH CUTTER FOR DISPENSING LIQUIDS FROM MULTI-LAYERED LAMINATE CONTAINERS

[75] Inventor: Robert M. Mitchell, Norwalk, Conn.

[73] Assignee: Ocean Spray Corporation, Plymouth, Mass.

[21] Appl. No.: 502,177

[22] Filed: Jun. 8, 1983

[51] Int. Cl.[4] ..... B65D 51/22

[52] U.S. Cl. ..... 222/83.5; 30/2; 222/86; 222/88; 222/533

[58] Field of Search ..... 222/81, 83, 83.5, 85, 222/86, 88–90, 478, 526–528, 533, 536, 537, 566, 567, 570; 30/2, 443

[56] References Cited

U.S. PATENT DOCUMENTS

| | | | |
|---|---|---|---|
| 2,015,079 | 9/1935 | Lindeburg | 222/83 |
| 2,112,470 | 3/1938 | Sevelle | 222/83.5 |
| 2,160,705 | 5/1939 | McManus et al. | 222/85 |
| 2,184,632 | 12/1939 | Clawson | 222/83 |
| 2,535,783 | 12/1950 | Churchill et al. | 222/89 X |
| 3,285,472 | 11/1966 | Olson | 222/86 |
| 3,347,444 | 10/1967 | Ravsing et al. | 229/17 R |
| 4,150,768 | 4/1979 | Maynard, Jr. | 222/89 |
| 4,216,880 | 8/1980 | Drelichowski | 222/83 |

*Primary Examiner*—Kevin P. Shaver

*Attorney, Agent, or Firm*—Kane, Dalsimer, Sullivan, Kurucz, Levy, Eisele and Richard

[57] ABSTRACT

An assembly for opening and dispensing liquids from so-called "paper bottles". The assembly comprises an open ended tubular body adapted to secure within the open end, a paper bottle. A dispenser spout traverses the closed end of the tubular body and pivots to present a cutting blade to the paper bottle. Liquid seal member prevents leakage from an opened bottle.

10 Claims, 8 Drawing Sheets

FIG.3
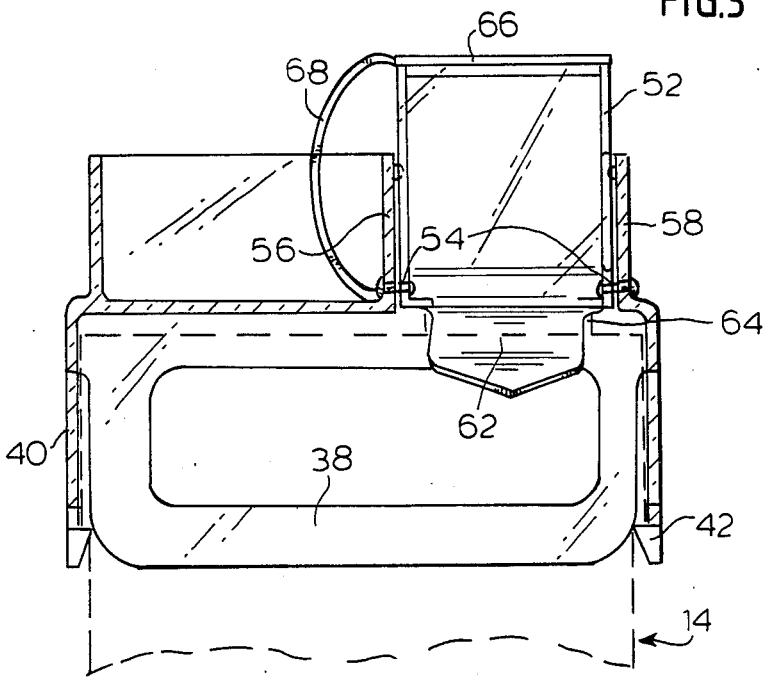
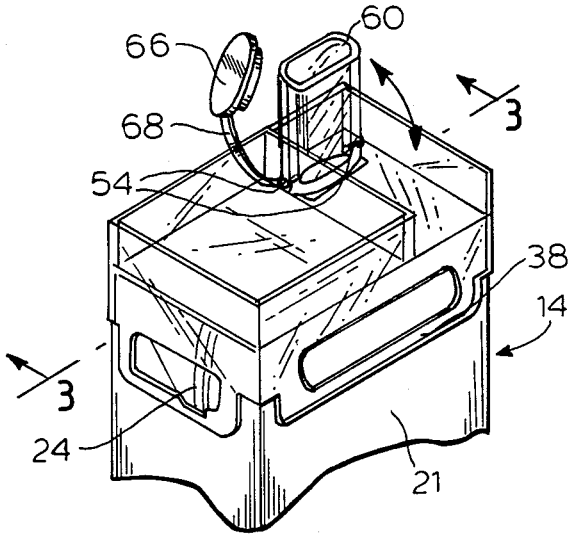
FIG.2

PIVOTAL SPOUT WITH CUTTER FOR DISPENSING LIQUIDS FROM MULTI-LAYERED LAMINATE CONTAINERS

BACKGROUND OF THE INVENTION

1. Field of the Invention

The invention relates to apparatus and devices for opening fluid containers and dispensing liquids contained therein.

2. Brief Description of the Prior Art

The patent literature is replete with description of means for opening liquid containers and for dispensing the liquids contanined therein. Representative of such descriptions are those found in the U.S. Pat. Nos. 2,015,079; 2,179,772; 2,184,632; 2,350,451; 2,551,099; 2,571,464; 2,571,798; 2,617,559; 2,912,141; 3,131,831; 3,160,322; 3,181,733; 3,187,918; 3,217,929; 3,241,728; 3,567,073; 3,820,511; 4,150,768; 4,216,880; and 4,314,654.

The assembly of the present invention is particularly useful for opening and dispensing liquids from heavy, multi-layered laminate "paper bottles" such as those described in U.S. Pat. No. 3,347,444.

SUMMARY OF THE INVENTION

The invention comprises, an assembly for dispensing the fluid contents of a fluid container which is a multi-layered laminate having first and second closed ends, said ends being joined together by a container body, which comprises;

(i) a tube having
  (a) a closed first end;
  (b) an open second end; and
  (c) sidewalls joining together the ends (a) and (b) and with the ends (a) and (b) defining a chamber which is adapted by size and configuration to receive one of the closed ends of the fluid container;
  (d) means associated with the sidewalls for securing the container end in said chamber;
  (e) an aperture in the closed end of the tube, providing open communication between said chamber and the outside of the tube closed end; and
  (f) a dispenser spout pivotably mounted on the closed first end (a) of the tube, adjacent to the aperture (e), said dispenser spout having 1. a first, nozzle end; and 2. a second end having a cutting blade thereon adapted to sever the closed end of the fluid container secured in the chamber; said spout being pivotably movable from a first position where the second end is outside of said aperture (e) to a second position where the second end traverses said aperture (e) and engages with the fluid container within said chamber; and (ii) liquid sealing means mounted in said chamber to seal between the aperture (e) and a fluid container secured in the chamber.

The assembly of the invention is useful for dispensing the fluid contents of a fluid container, particularly of the type which comprises a multi-layered laminate such as the commonly referred to "paper bottle".

BRIEF DESCRIPTION OF THE DRAWINGS

FIG. 2 is a view of the embodiment assembly shown in FIG. 1, mounted on the container and ready for use.

FIG. 3 is a view along lines 3—3 of FIG. 2.

DETAILED DESCRIPTION OF THE PREFERRED EMBODIMENTS OF THE INVENTION

Figure 1:
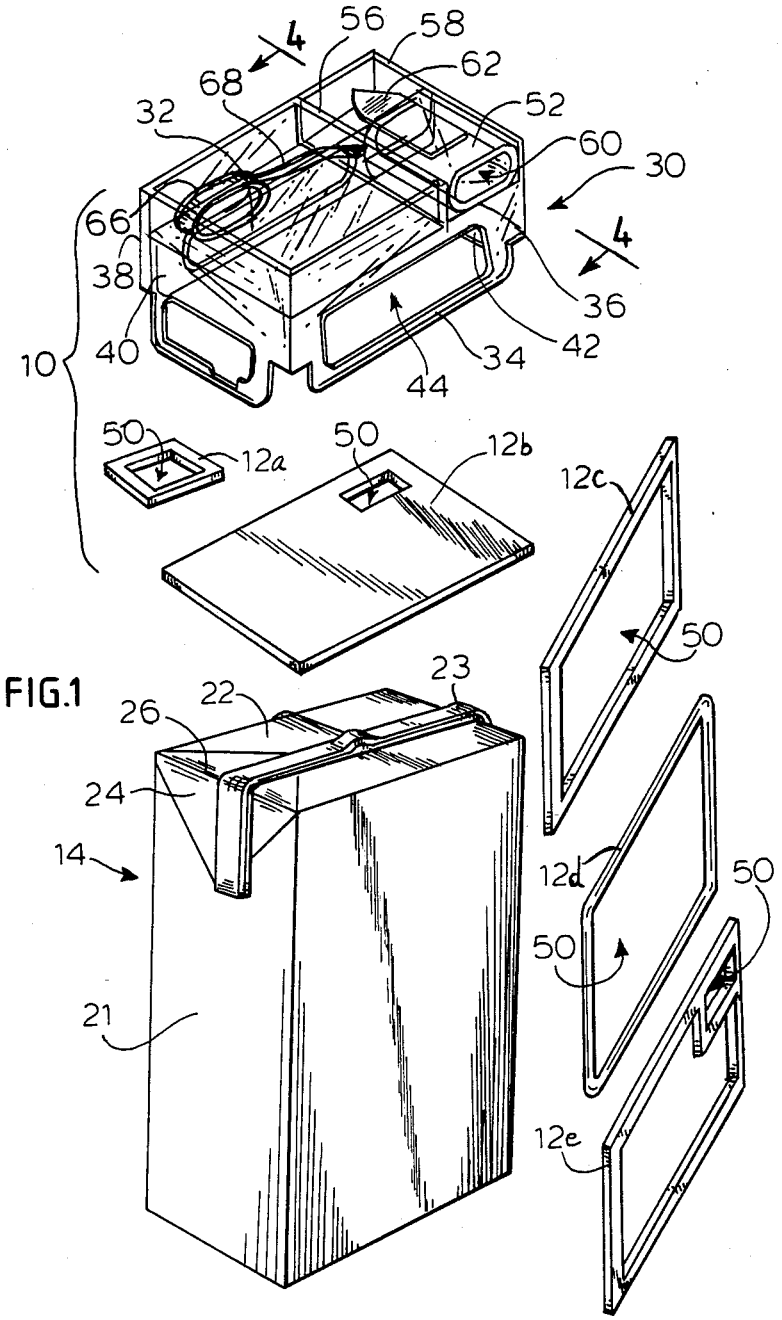
FIG. 1 is a view-in-perspective of an embodiment assembly of the invention, with alternate liquid seal means, and a container to which the assembly is adapted for use.

FIG. 1 is a view-in-perspective of an embodiment assembly 10 of the invention with alternate liquid seal means 12 *a–e* and a container 14 for which the assembly 10 of the invention is adapted for use. The container 14 comprises a generally rectangular carton made from flexible but relatively stiff web material which is a laminate of several layers. The layers may be cellulose, i.e.; paper or metallic foils, usually a combination of both. The laminate webs are formed into tubes and closed by flat pressing and transverse sealing, whereby a sealing fin 23 is folded down against the top end wall 22 of the container 14. Four triangular, double-walled flaps 24 are formed, three of which have been folded in against the bottom and the remote sidewall, so that only one flap 24 is visible in the FIG. 1. The visible flap 24 is foled around the straight side wall edge 26 and fixed by means of a breakable bond to the sidewall 21, associated with edge 26. The sealing fin 23 extends across both the flap 24, end wall 22 and the folded down flap, not shown, at the opposite side of the sidewall 21. Further details of the construction of the container 14 may be found in the U.S. Pat. No. 3,347,444. For the purpose of the present invention, it need only be appreciated that "paper bottles" of the type represented by container 14 are generally very resistant to puncture and unsealing.

The assembly 10 of the invention as shown in FIG. 1 comprises a tube 30 having a closed first end 32, an open second end 34 and sidewalls 36, 38, 40 and 42 (the latter not fully shown in FIG. 1, but opposite to and identical to sidewall 40). The ends 32, 34 together with sidewalls 36, 38, 40 and 42 define an interior, open chamber 44. The chamber 44 is of a size and configuration to receive through open end 34 the top end 22 of container 14 in a close, interference fit. Interposed between the inner surface of closed first end 32 and the top end 22 of container 14 is a liquid-proof sealing means, i.e.; a gasket. Shown in FIG. 1 are alternative gaskets 12*a*, 12*b*, 12c, 12d and 12e. The gaskets differ, essentially, only in the surface area of the gaskets. The area necessarily sealed between the ends 22 and 32 being only the periphery of an open area 50 between the ends 22, 32 when the container 14 is inserted in the chamber 44. The open area 50 will be described more fully hereinafter. The gaskets 12a, 12b, 12c, 12d and 12e are advantageously formed or fabricated from a compressible, synthetic polymeric resin foam such as a polyurethane or polyethylene foam. The uncompressed thickness of the gaskets 12a, 12b, 12c, 12d and 12e is advantageously in slight excess over the distance between the ends 22, 32 when the container 14 is inserted in the chamber 44, limited by full insertion through engagement of the container flaps 24 and the terminal ends of the sealing fin 23.

FIG. 2 is a view of the embodiment assembly 10 shown in FIG. 1, mounted on the container 14 and ready for use. As may be seen, the container flaps 24 (on both sides of the container 14) engage with sidewalls 40 and 42 through openings through the sidewalls 40, 42. The openings are of a size and configuration to engage the protruberance of the flaps 24 and the terminal ends of the sealing fin 23. The assembly 10 is secured to the top end 22 of container 14 by inserting the container within chamber 44 and pressing the assembly 10 and carton 14 together so as to compress the interposed gasket 12a, 12b, 12c, 12d or 12e until the flaps 24 engage the sidewalls 40 and 42. The compressed gaskets 12a, 12b, 12c, 12d or 12e act as a spring to force the assembly 10 away from the container 14. With the flaps 24 holding against the force, a tension is created which secures the assembly 10 in place.

Referring again to FIG. 1, there is also seen mounted on the outside of end 32 of tube 30 a spout 52, pivotably mounted on pivot pin 54 which is in turn mounted on support flanges 56, 58. Pin 54 may be removable to disassemble the nozzle 52 for cleaning. The spout 52 includes a nozzle end 60 and a second end having attached thereto a punch blade 62. In FIG. 1, the spout 52 and attached blade 62 are in a first position for shipping and handling. An aperture 64 (not seen in FIG. 1) is placed in line beneath the cutting edge of blade 62 in the closed end 32 so as to provide open liquid communication between the interior chamber 44 and the outside of the end 32. When the spout 52 is pivoted on the pivot pin 54 as shown in FIG. 2, the cutting blade 62 passes through the aperture 64 and into chamber 44 to cut the top end 22 of a container 14 locked or secured in the chamber 44 as previously described. An interference fitting cap 66 attached to a tether 68 closes the nozzle 60. The use of a tether 68 is optional and any conventional interference or "snap-cap" closure may be used as the cap 66.

FIG. 3 is a view along lines 3—3 of FIG. 2 and shows in greater detail the assembly 10, with cap 66 secured in the nozzle 60 of spout 52. The blade 62 has been moved to a position through the aperture 64 and into the space which comprises inner chamber 44. As also shown, optional portions of the sidewall 38 (and also sidewall 36) have been cut out to reduce the material requirements and to lighten the assembly 10. The cut-out portions may be positioned so that underlying portions of the container 14 may be viewed for advertisements, instructions, etc. Cut-away portions also make the sidewalls more flexible. The sidewalls 36, 38 may also be used as a means of securing the assembly 10 to a container 14 by biasing the sidewalls inwardly. Forced apart by insertion of the container 14, the biased sidewalls 36, 38 exert a gripping action upon the container 14 to further secure the assembly 10 in place.

Figure 5:
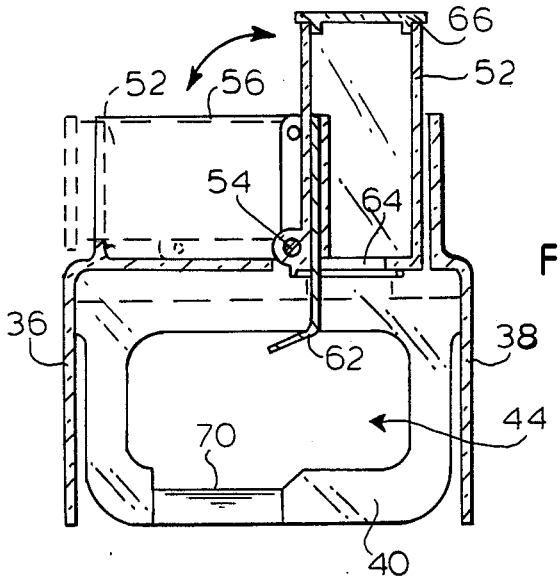
FIG. 5 is a view as in FIG. 4 but with the pouring spout in the position shown in FIG. 2.
Figure 4:
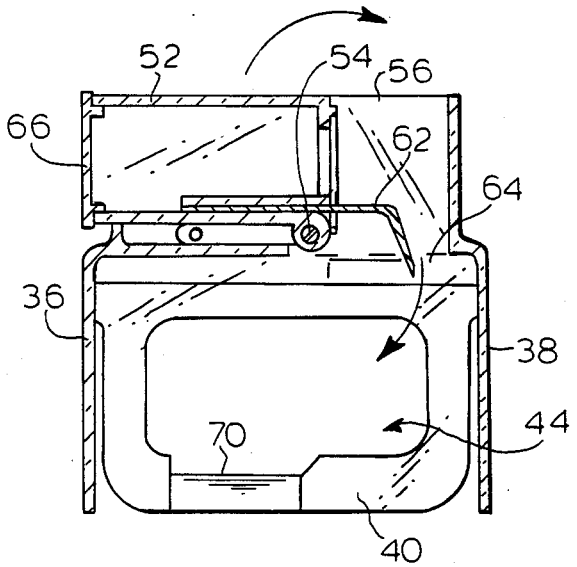
FIG. 4 is a view along lines 4—4 of FIG. 1.

FIG. 4 is a view along lines 4—4 of FIG. 1 and shows clearly the first position of the pivotable spout 52 and attached blade 62. FIG. 5 is a view as in FIG. 4 but with the spout 52 pivoted to an upright second position. With a container 14 in the chamber 44, movement of the spout 52 levers the blade 62 component into the top end 22 of the container 14, puncturing the container 14 and placing the spout 52 in position over the punctured opening. The lever action facilitates puncture of the tough walls of container 14. The gasket 12a, 12b, 12c, 12d or 12e seals the passage between the punctured opening in the container 14 and spout 52 so that the liquid contents of the container 14 may be decanted through spout 52 and out of the uncapped nozzle 60. When the contents of the container 14 have been emptied, the spout 52 may be returned to the first position shown in FIG. 4 and the assembly 10 pulled off container 14.

FIG. 4 and FIG. 5 also show that the cut-away portion of sidewall 40 (and also sidewall 42) includes a notch 70 for mating with the terminal end of the sealing fin 23 on container 14 and securing the container 14 thereto.

Figure 6:
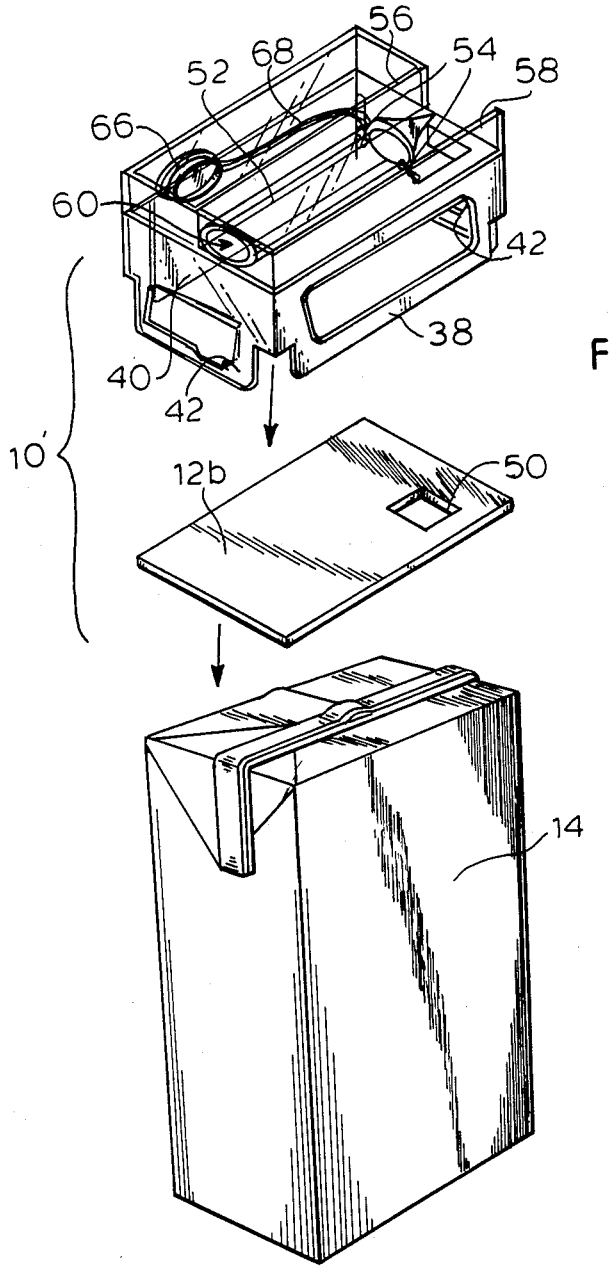
FIG. 6 is a view-in-perspective of an alternate embodiment assembly of the invention, and a container for its attachment.

FIG. 6 is a view-in-perspective of an alternate embodiment assembly 10′ of the invention, ready to be assembled to a container 14. In the FIG. 6, all parts of the assembly 10′ are numbered with the same numbers used for corresponding parts of the embodiment shown in FIGS. 1–5. In the embodiment of FIG. 6, the nozzle 52 is positioned at a 90° angle to the position of the nozzle 52 in the embodiment of FIGS. 1–5.

Figure 9:
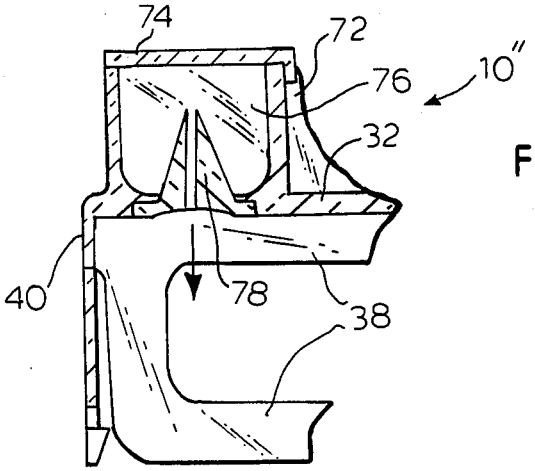
FIG. 9 is a view as in FIG. 8, but of the vent mechanism assembled for shipping before use.
Figure 8:
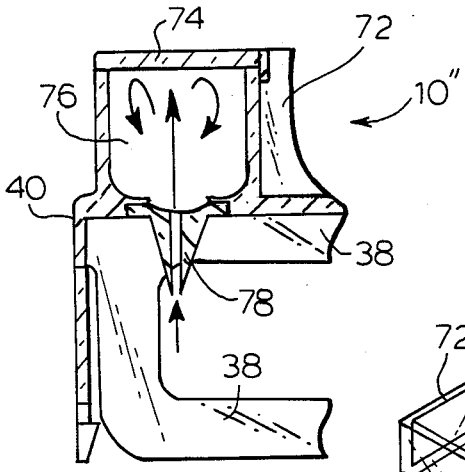
FIG. 8 is a view along lines 8—8 of FIG. 7.
Figure 7:
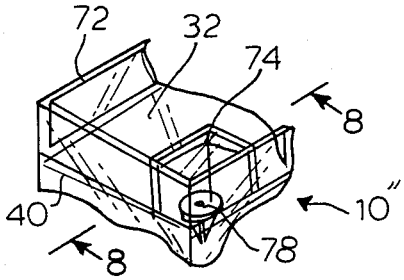
FIG. 7 is a view of a vent mechanism of a preferred embodiment assembly of the invention.

FIGS. 7–9 are views of portions of a preferred embodiment assembly 10″ of the invention which incorporates a venting means, to vent the container 14 during its being emptied of liquid contents. In the assembly 10″ shown in the FIGS. 7–9, parts comparable to those of the assembly 10 shown in FIGS. 1–5 are similarly numbered. Referring first to FIG. 7, a view in perspective of an upper corner of the assembly 10″ shows that on the outer surface of the closed end 32 of the tube 30, flange 72 around the outer periphery of the end 32 forms an open enclosure. A portion of the enclosed area is closed in with housing 74 to form an air chamber 76. A hollow spike 78 will puncture the container 14 inserted in chamber 44, providing a fluid passage between the interior of the container 14 and the air chamber 76 through the spike 78. As shown by the arrows in FIG. 8, the structure functions as a vent. Since the air chamber 76 is closed, liquid contents of the container 14 cannot spill. The air chamber 76 should contain a sufficient volume of air to provide vent means for emptying at least partially the contents of the container 14. FIG. 9 shows that the spike 78 is removable from its attachment as shown in FIG. 8, reversible and re-attached for shipping and storage, when desired. The spike 78 may be secured by an interference fit in a slot on the underside of the top end 32.

Figure 10:
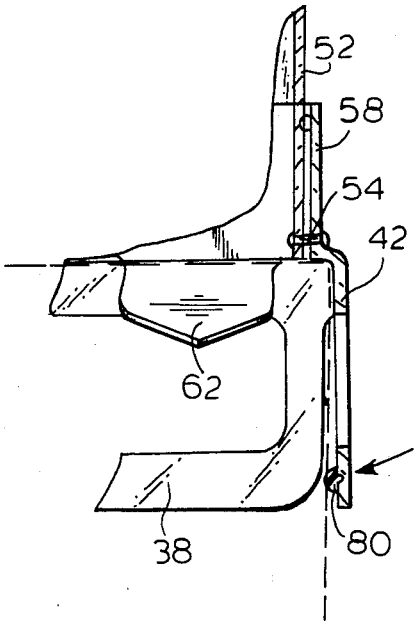
FIG. 10 is a side view of a portion of an alternate embodiment assembly of the invention showning an alternate means of securing the assembly of the invention to a fluid container.

Many modifications of the above described preferred embodiments of the invention may be made without departing from the spirit and the scope of the invention. For example, referring to FIG. 10 one may see a portion of an assembly 10 as previously described, modified by the presence of a friction bar 80 mounted on the inner aspect of the sidewall 42 (also sidewall 40) to engage with the sidewall of the inserted container 14 in frictional relationship to further assist in holding the assembly 10 in place on the container 11.

Figure 11:
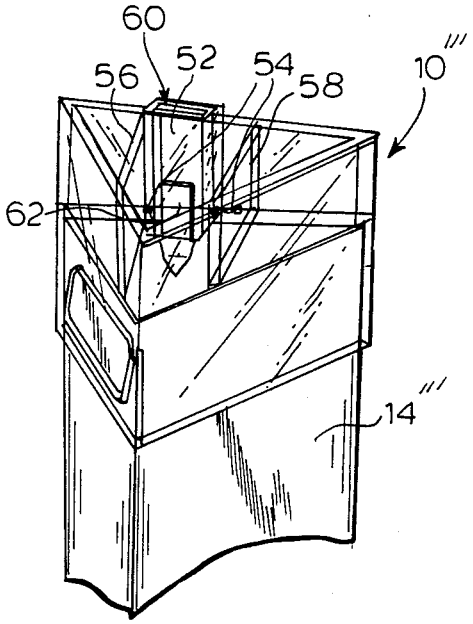
FIG. 11 is a view-in-perspective of another embodiment assembly of the invention.
Figure 12:
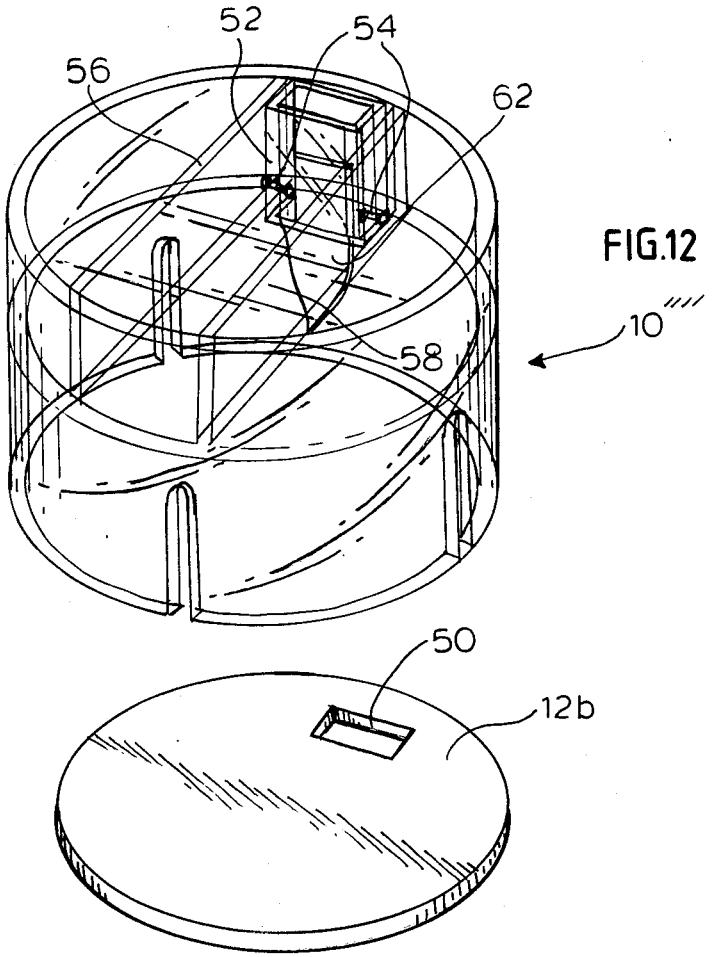
FIG. 12 is a view-in-perspective of still another embodiment assembly of the invention.

Also, it is not necessary that the assembly 10 of the invention or the container it is used upon be limited to any particular shape. As shown in FIG. 11, the assembly 10''' may be triangular in shape to associate with a triangular container 14'''. The numbers assigned to component parts of the assembly 10''' are the same numbers assigned to the same or corresponding parts of the assembly 10 shown in FIGS. 1–5. Similarly, a round assembly 10''' is shown in FIG. 12, for attachment to a round fluid container.

Figure 13:
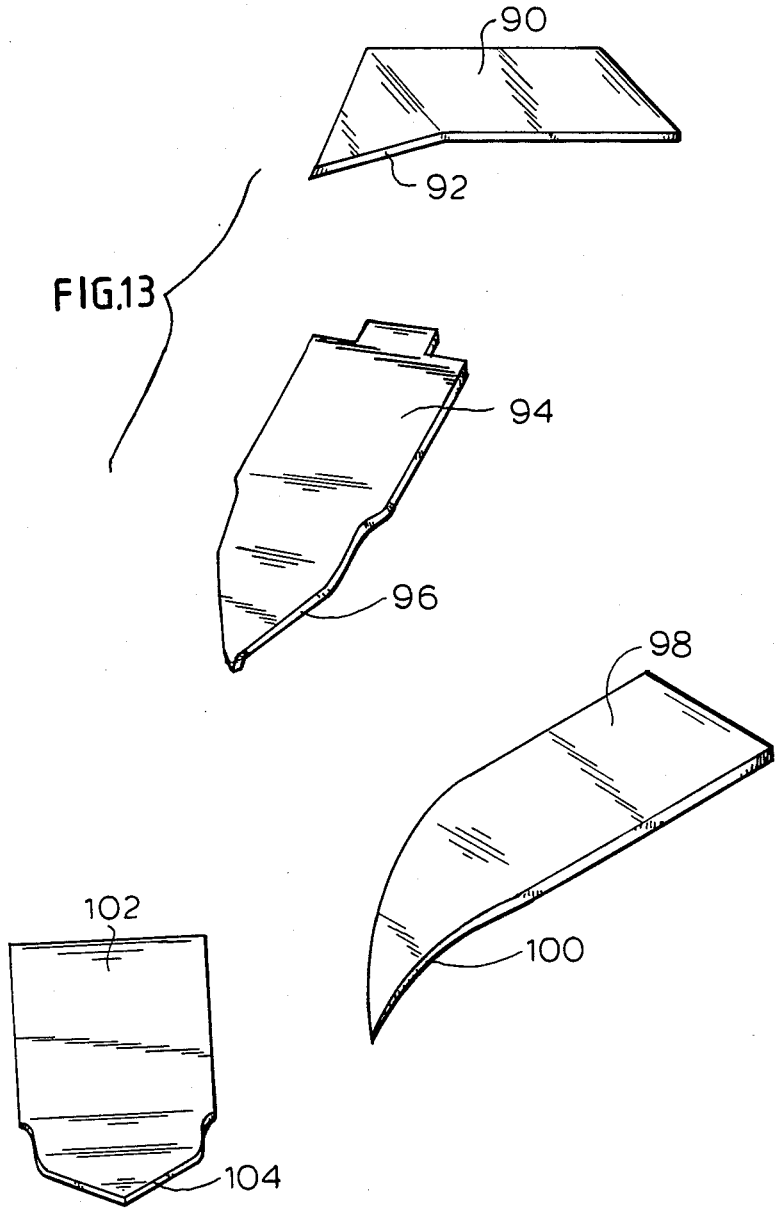
FIG. 13 shows in perspective, several embodiment severing blades, useful as blade components of the assemblies of the invention.

The blade 52 component may also be modified in many ways. FIG. 13 shows in perspective several embodiment blades which may be advantageously used in the assemblies of the invention. The blade 90 is a simple configuration, wherein the straight cutting edge 92 is on an end bent downward on an angle of from about 20 to 30 degrees. The blade 94 has a non-linear cutting edge 96, also on a portion or end similarly bent downward. This blade 94 is particularly advantageous in that it tends to prevent "springback" of severed laminate webs, which would tend to close the puncture. The blade 98 has a curved cutting edge 100, whereas the blade 102 has a flat cutting edge 104.

The assemblies of the invention may be fabricated from any conventional materials, such as polymeric resins, metal and the like. Preferably, the blades are made of steel and the remainder of the assemblies of polypropylene, but the blades may also be made of a suitable rigid plastic.

What is claimed:

1. An assembly for dispensing the fluid contents of a fluid container which is a multi-layered, laminate having first and second closed ends, said ends being joined together by a container body, which comprises;

(i) a tube having (a) a closed first end;

(b) an open second end; and (c) sidewalls joining together the ends (a) and (b) and with the ends (a) and (b) defining a chamber which is adapted by size and configuration to receive one of the closed ends of the fluid container;

(d) means associated with the sidewalls for securing the container end in said chamber;

(e) an aperture in the closed end of the tube, providing open communication said chamber and the outside of the tube closed end; and (f) a dispenser spout pivotably mounted on the closed first end (a) of the tube, adjacent to the aperture (e), said dispenser spout having 1. a first, nozzle end; and 2. a second end having a cutting blade thereon adapted to sever the closed end of the fluid container secured in the chamber; said spout being pivotably movable from a first position where the second end is outside of said aperture (e) to a second position where the second end traverses said aperture (e) and engages with the fluid container within said chamber; and (ii) liquid sealing means mounted in said chamber to seal between the aperture (e) and a fluid container secured in the chamber.

2. The assembly of claim 1 wherein the means associated with the sidewalls comprises a cut-out portion of the sidewalls.

3. The assembly of claim 2 wherein the sidewalls are biased inwardly.

4. The assembly of claim 1 wherein the liquid sealing means comprises a gasket of compressible, synthetic polymeric resin foam.

5. The assembly of claim 1 wherein said tube (i) is rectangular.

6. The assembly of claim 1 wherein said tube (i) is triangular.

7. The assembly of claim 1 wherein said tube (i) is round.

8. The assembly of claim 1 wherein the nozzle end of the spout is closed with a removable closure.

9. The assembly of claim 1 wherein a hollow spike is mounted in the chamber on the closed first end, and a vent communicates through the closed first end through the hollow spike.

10. The assembly of claim 1 wherein the blade has a cutting edge which bends downward at an angle of from about 20 to 30 degrees from the axis of the blade body

* * * * *

UNITED STATES PATENT AND TRADEMARK OFFICE

CERTIFICATE OF CORRECTION

PATENT NO. : 4,771,916

DATED : September 20, 1988

INVENTOR(S) : Robert M. Mitchell

It is certified that error appears in the above-identified patent and that said Letters Patent is hereby corrected as shown below:

Col. 1, line 12; "description" should read -- descriptions -- .

Col. 2, line 18; "showning" should read -- showing -- .

Col. 2, line 47; "foled" should read -- folded -- .

Col. 5, line 11; "10'" " should read -- 10"" -- .

Col. 6, line 4; between the words "communication" and "said" insert the word -- between -- .

Signed and Sealed this

Twenty-eighth Day of March, 1989

*Attest:*

*Attesting Officer*

DONALD J. QUIGG

*Commissioner of Patents and Trademarks*